US006345484B1

(12) United States Patent
Oliver et al.

(10) Patent No.: US 6,345,484 B1
(45) Date of Patent: Feb. 12, 2002

(54) BRACE FOR MATING SEAM OF MULTI-SECTION MANUFACTURED HOME

(76) Inventors: James Oliver; Evon L. Oliver, both of P.O. Box 58, Hohenwald, TN (US) 38462

( * ) Notice: Subject to any disclaimer, the term of this patent is extended or adjusted under 35 U.S.C. 154(b) by 0 days.

(21) Appl. No.: 09/459,564

(22) Filed: Dec. 13, 1999

(51) Int. Cl.[7] ..... E04B 5/43

(52) U.S. Cl. ..... 52/702; 52/79.9; 52/223.11; 52/223.8; 52/638

(58) Field of Search ..... 52/702, 79.9, 79.12, 52/79.13, 92.2, 125.6, 126.5, 146, 152, 151, 167.3, 299, 638, 703, 223.8, 640, 645, 223.11, 223.13

(56) References Cited

U.S. PATENT DOCUMENTS 414,976 A * 11/1889 Harvey ..... 52/223.8
573,452 A * 12/1896 Hunt ..... 52/640
591,405 A * 10/1897 Jenkins ..... 52/640
1,378,483 A * 5/1921 Olson ..... 52/223.8
2,510,958 A * 6/1950 Coff ..... 52/223.8
2,577,582 A * 12/1951 Hammitt et al. ..... 52/223.8
2,637,421 A * 5/1953 Wolfard ..... 52/223.11
2,799,369 A * 7/1957 Walton ..... 52/223.8
3,335,531 A * 8/1967 Grimelli et al. ..... 52/702
3,398,498 A * 8/1968 Krauss ..... 52/223.8
4,068,420 A * 1/1978 Rice ..... 52/79.9
4,353,190 A * 10/1982 Gleeson ..... 52/226
5,337,531 A * 8/1994 Thompson et al. ..... 52/640
5,697,191 A * 12/1997 MacKarvich ..... 52/169
5,758,460 A * 6/1998 MacKarvich ..... 52/292

* cited by examiner

*Primary Examiner*—Carl D. Friedman
*Assistant Examiner*—Phi Dieu Tran A
(74) *Attorney, Agent, or Firm*—Calif Tervo

(57) ABSTRACT

A brace for a multi-section manufactured home comprising left and right sections; each section having a beam having an upper end including a lateral flange supporting a floor structure, and a medial side; the floor structures meeting at a mating seam distal from each beam, generally comprises left and right brackets joined by a steel strap, a tensioning bolt for the strap, a vertical post, and a horizontal compression member. Left and right brackets include an outer hook for beam attachment by hooking over the lateral flange of left and right beams respectively. The strap is attached to a take-up bolt on one bracket for adjusting strap tension. The post is supported by the midsection of the strap and supports the left floor structure and the right floor structure across the mating seam.

26 Claims, 1 Drawing Sheet

BRACE FOR MATING SEAM OF MULTI-SECTION MANUFACTURED HOME

BACKGROUND OF THE INVENTION

1. Field of the Invention

This invention relates to a support for the marriage or mating seam of a multi-section manufactured home, mobile home, or trailer coach, and more specifically to an adjustable brace for application in situ for supporting the mating seam.

2. Description of the Related Art

The maximum width of a manufactured home is typically restricted to the maximum width allowable for common transport on public highways. Consequently, two or more manufactured home sections often are transported separately and then joined to form a wider, larger manufactured home. A larger manufactured home may be called a "multi-section", or a "double-wide" or a "triple-wide", as appropriate.

The floor juncture of the two sections is called a mating seam or a marriage seam. Conventionally, the floors adjacent the mating seam are only directly supported by the cantilevered ends of traverse floor joists, such that the seam is wavy and/or floors on either side of the seam do not align to form a flat surface. Of course, such results are undesirable.

A section for a multi-section manufactured home typically includes one or more longitudinal main I-beams which support a plurality of transverse floor joists which directly support the floor and the wall structure including wall studs. A plurality of spaced support piers support the main beams.

Conventionally, the mating seam has been supported, if at all, by vertical perimeter jacks disposed between the ground and the outer end of the joists. Conventional perimeter jacks have several disadvantages. For example, it is common for the support piers to settle and to settle by differing amounts such that the load on a particular perimeter pier will increase to unacceptable levels, even to failure level. Also, support piers need frequent adjustment to even the loading on the main beams. Each such adjustment requires that the perimeter jacks be adjusted also.

Therefore, there has been a need for means for supporting the mating seam of a manufactured home that overcomes the shortcomings of the prior art.

Preferably, the support means is easily applied in situ in the field.

SUMMARY OF THE INVENTION

This invention is a brace for a multi-section manufactured home; the home comprising left and right sections; each section having a beam having an upper end including a lateral flange supporting a floor structure, and a medial side; the floor structures meeting at a mating seam distal from each beam. The brace generally comprises left and right brackets joined by a steel strap, a tensioning bolt for the strap, a vertical post, and a horizontal compression member.

Left and right brackets include an outer hook for beam attachment by hooking over the lateral flange of left and right beams respectively. The strap is attached to a take-up bolt on one bracket for adjusting strap tension. The post is supported by the midsection of the strap and supports the left floor structure and the right floor structure across the mating seam.

A horizontal compression member spans between the medial side of the left section beam and the medial side of the right section beam substantially between the brackets.

Preferably, the post supports the midsection of the horizontal compression member. Preferably, the right bracket is attached to the right section beam in front of the horizontal compression member, and the left bracket is attached to the left section beam in back of the horizontal compression member. A bearing on the post reduces friction during tensioning of the strap/

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
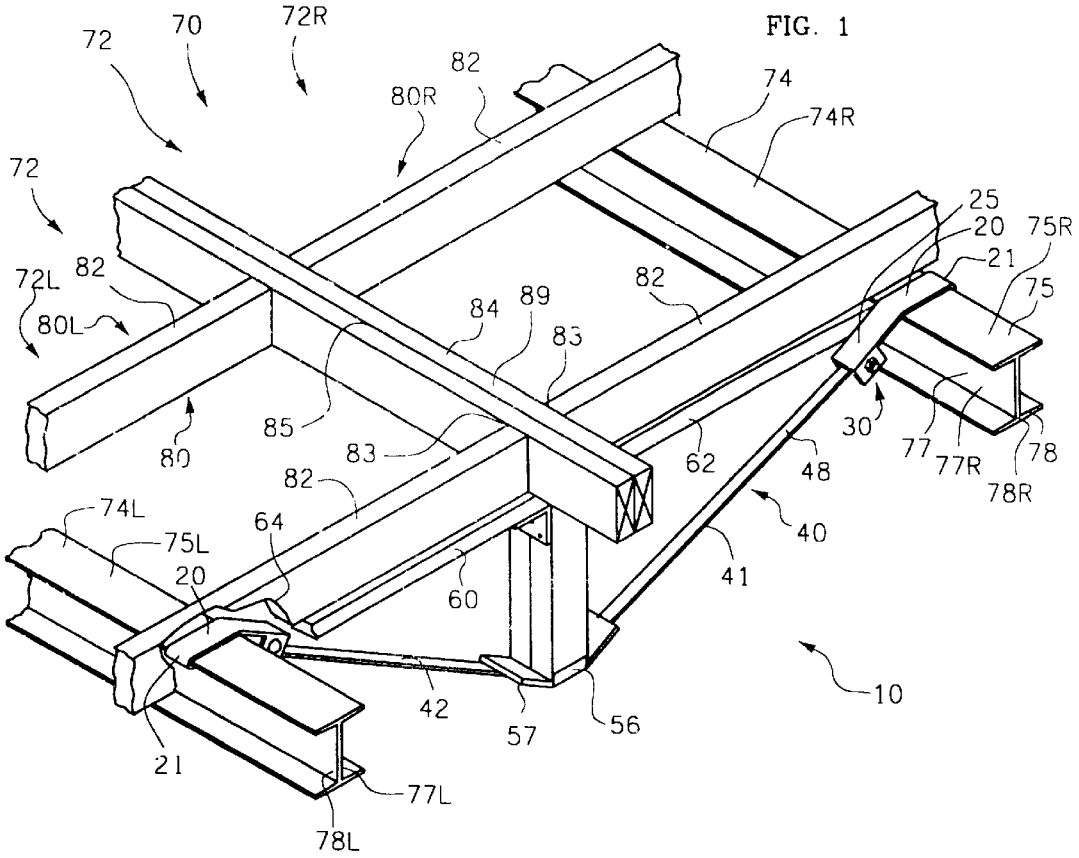
FIG. 1 is a partial perspective view, partially cut away, of a multi-section manufactured home and a preferred embodiment of the adjustable brace of the invention.
Figure 2:
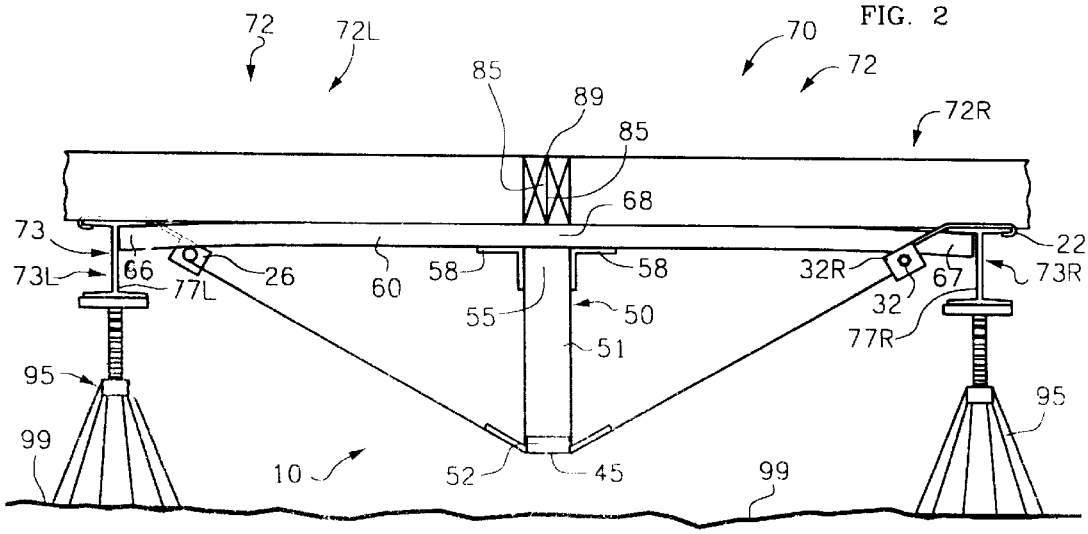
FIG. 2 is front elevation view of FIG. 1.

With reference now to the drawing where "L" and "R" designate "left" and "right" members respectively, FIG. 1 is a partial perspective view, partially cut away, of a multi-section manufactured home 70 including a plurality of floor support sections 72, including a left section 72L and a right section 72R, meeting at a mating seam 89 and a preferred embodiment of the adjustable brace 10 of the invention for supporting mating seam 89. FIG. 2 is front elevation view of FIG. 1.

Each floor support section 72 (72L, 72R) includes a longitudinal beam 73 (73L, 73R) having an upper end 74 (74L, 74R) including a lateral flange 75 (75L, 75R) supporting floor structure 80 (80L, 80R), a medial side 77 (77L, 77R), and a lower end 78 (78L, 78R). Lower end 78L, 78R of each beam 73L, 73R is supported, such as by spaced jacks 95, a foundation or the like, above the ground 99.

Floor structures 80L,80R meet at mating seam 89 distal from beams 73L, 73R. Each floor structure 80L, 80R includes lateral joists 82 supported by beams 73. Lateral joists 82 have a medial end 83 at or near mating seam 89. Typically, outer joists 84, connect and cover the ends 83 of lateral joists 82 such that the medial sides 85 of left and right outer joists 84L, 84R join at mating seam 89.

Brace 10 generally comprises a pair of brackets 20 joined by strong flexible tension member 40, a tensioning means 30, a 30 vertical compression member 50, and a horizontal compression member 60.

Left and right brackets 20L, 20R are attached to left and right beams 73L, 73R respectively. Left and right brackets 20L, 20R each include an outer end 21 adapted, such as including a hook portion 35 22, for attachment to its respective beam 73, such as by simply hooking over lateral flange 75 in the space between lateral joists 82. Alternately, brackets 20 could be attached by welding or fasteners. Left and right brackets 20L,20R each include an inner end 25 adapted, such as including retaining bolt 26, for attachment to tension member 40.

Strong flexible tension member 40 includes a left end 42 attached to left bracket 20L, such as by bolt 26L, a right end 48 attached to right bracket 20R, such as by bolt 26R, and a midsection 45 therebetween. Tension member 40 may be of any suitable material and dimension, such as steel cable or strap 41, shown.

In the embodiment shown, tensioning means 30, for adjusting the tension in tension member 40, includes a take-up attachment bolt 32, such as take-up bolt 32R on inner end 25 of right bracket 20R. Take-up bolt 32R may be of any standard type well-known in the art and includes means, such as a slot, for attachment of tensioning means, such as strap 41, and includes means such as a square collar for selective interaction with bracket 20R to prevent rotation. Steel strap 41 is attached to bolt 32R and the bolt is rotated to coil strap 41 therearound, thus tensioning strap 41. Other tensioning means are contemplated.

An embodiment of the invention includes a bracket 20 of ¼" steel, 2" wide and 9" long with a 1.25" hook 22 and a tension member 40 of 0.044" thick steel strap having a breaking strength of 6750 pounds.

Vertical compression member 50, such as post 51, includes a lower end 52 supported by midsection 45 of tension member 40 and an upper end 55 supporting left floor structure 80L and right floor structure 80R across mating seam 89. Post 51 may be a 4"×4" post or two 2"×2" posts nailed together. Post upper end 55 may be attached, such as by toe nailing or with angle brackets 58 to floor structure 80.

Bearing means 56, such as steel plate 57 on lower end 52 of said 51, reduces friction between post 51 and strap 41 during tensioning of strap 41 to provide uniform tensioning in strap 41 even if single tensioning means to one side of post 51 is employed. A single tension member and a single tensioning means as taught in this invention is preferable over multiple tension members and/or tensioning means because multiple members require coordinated or simultaneous adjustment to achieve the desired tension or otherwise may lead to unequal stresses in the structure.

Brace 10 as above described may be attached to beams 73L, 73R anywhere along their length, but bigger upward forces on post 51 can be attained if brace 10 is attached directly under co-linear lateral joists 82. In which case, left bracket 20L is attached to left beam 73L in back of joist 82L,and right bracket 20R is attached to right beam 73R in front of joist 82R.

Horizontal compression member 60, such as an elongate 2"×4" board, allows larger upward forces on post 51 to be attained. Horizontal compression member 60 includes a front 62, a back 64, a left end 66, a right end 67, and a midsection 68. Horizontal compression member 60 is placed to bear against medial side 77 of beam 73L and medial side 77 of right beam 73R, preferably under co-linear lateral joists, substantially between brackets 20. Horizontal compression member may be attached, such as by nailing, to floor structure 80.

Preferably, as shown in the preferred embodiment, upper end 55 of post 51 supports midsection 68 of horizontal compression member 60, and left bracket 20L is attached to left beam 73L in back of compression member 60 and right bracket 20R is attached to right beam 73R in front of compression member 60 such that strap 41 crosses under horizontal compression member 60 at post 51. Angle brackets 58 strengthen the attachment between post 51 and horizontal compression member 60 or floor structure 80.

Having described the invention, it can be seen that brace 10 provides a very desirable device for supporting the mating seam 89 of a multi-section manufactured home. Importantly, brace 10 of the invention is easily applied in situ and requires only a wrench and a hammer or screw driver. Post 51 and horizontal compression member 60 may generally be fabricated from the shipping materials. No drilling, cutting or other fabrication is required. One person can quickly and easily attach brace 10.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A brace for a multi-section manufactured home comprising a left section having a left floor structure and a right section having a right floor structure; the left section having a beam having: an upper end supporting the left floor structure, a medial side, and a lower end; the right section having a beam having: an upper end supporting the right floor structure, a medial side, and a lower end; the floor structures meeting at a mating seam distal from each beam; said brace comprising:

an elongate strong flexible tension member including:
- a left end;
- a right end; and
- a midsection therebetween;

right bracket including:
- an outer end for attachment to the upper end of the right section beam; and
- an inner end attached to said right end of said tension member;

left bracket including:
- an outer end for attachment to the upper end of the left section beam; and
- an inner end attached to said left end of said tension member;

a vertical compression member including:
- a lower end supported by said midsection of said tension member; and
- an upper end adapted for supporting the left floor structure and the right floor structure across the mating seam;

tensioning means for adjusting the tension in said tension member; and a horizontal compression member including:
- a front;
- a back;
- a left end;
- a right end; and
- a midsection therebetween; said horizontal compression member adapted to span between the medial side of the left section beam and the medial side of the right section beam substantially between said brackets; wherein said outer end of said right bracket is adapted to attach to the right section beam in front of said horizontal compression member; and said outer end of said left bracket is adapted to attach to the left section beam in back of said horizontal compression member.

2. The brace of claim a wherein:

said upper end of said vertical compression member supports said midsection of said horizontal compression member.

3. The brace of claim 1 wherein:

said tensioning means includes a take-up attachment bolt on said right bracket.

4. The brace of claim 1 wherein:

said vertical compression member further includes:
- bearing means on said lower end of said vertical compression member for reducing the friction between said vertical compression member and said tension member during tensioning.

5. A brace for a multi-section manufactured home comprising a left section having a floor structure and a right section having a floor structure; the left section having a beam having: an upper end including a lateral flange supporting the left floor structure, a medial side, and a lower end; the right section having a beam having: an upper end including a lateral flange supporting the right floor structure, a medial side, and a lower end; the floor structures meeting at a mating seam distal from each beam; said brace comprising:

a strong flexible tension member including:
- a left end;
- a right end; and
- a midsection therebetween;

right bracket including:
- an outer end adapted for attachment to the right section beam by hooking over the lateral flange of the right section beam;
- an inner end attached to said right end of said tension member;

left bracket including:
- an outer end adapted for attachment to the left section beam by hooking over the lateral flange of the left section beam; and
- an inner end attached to said left end of said tension member;

a vertical compression member including:
- a lower end supported by said midsection of said tension member; and
- an upper end adapted for supporting the left floor structure and the right floor structure across the mating seam; and tensioning means for adjusting the tension in said tension member; and a horizontal compression member including:
- a front side;
- a back side;
- a left end;
- a right end; and
- a midsection therebetween; said horizontal compression member adapted to span between the medial side of the left section beam and the medial side of the right section beam substantially between said brackets; wherein: said outer end of said right bracket is adapted to attach to the right section beam in front of said horizontal compression member; and said outer end of said left bracket is adapted to attach to the left section beam in back of said horizontal compression member.

6. The brace of claim 5 wherein:

said upper end of said vertical compression member supports said midsection of said horizontal compression member.

7. The brace of claim 5 wherein:

said tensioning means includes a take-up attachment bolt on said right bracket.

8. The brace of claim 5 wherein:

said vertical compression member further includes:
- bearing means on said lower end of said vertical compression member for reducing the friction between said vertical compression member and said tension member during tensioning.

9. A method for supporting the mating seam of a multi-section manufactured home comprising a left section and a right section; the left section having a beam including: an upper end supporting a left floor structure, a medial side, and a lower end; the right section having a beam including: an upper end supporting a right floor structure, a medial side, and a lower end; the floor structures meeting at a mating seam distal from each beam; said method including:

attaching a right bracket to the upper end of the right section beam;

attaching a left bracket to the upper end of the left section beam;

attaching one end of a strong flexible tension member to the right bracket;

attaching the other end of the tension member to the left bracket; and tensioning the tension member such that the tension member supports the lower end of a vertical compression member such that the upper end of the vertical compression member supports the left floor structure and the right floor structure across the mating seam.

10. The method of claim 9 further including:

spanning with a horizontal compression member between the medial side of the left section beam and the medial side of the right section beam substantially between the bracket attachment points.

11. The method of claim 10 further including:

supporting the horizontal compression member with the upper end of the vertical compression member.

12. The method of claim 10 wherein:

in the step of attaching the right bracket to the upper end of the right section beam: the right bracket is attached in front of the horizontal compression member; and in the step of attaching the left bracket to the upper end of the left section beam: the left bracket is attached to the left section beam in back of the horizontal compression member such that the tension member crosses under the horizontal compression member.

13. A method for supporting the mating seam of a multi-section manufactured home comprising a left section and a right section; the left section including a beam including: an upper end including a lateral flange supporting a left floor structure, a medial side, and a lower end; the right section including a beam including: an upper end including a lateral flange supporting a right floor structure, a medial side, and a lower end; the floor structures meeting at a mating seam distal from each beam; said method including:

attaching a right bracket having a hooked end to the lateral flange of the right section beam by hooking the hooked end over the lateral flange of the right section beam;

attaching a left bracket having a hooked end to the lateral flange of the left section beam by hooking the hooked end over the lateral flange of the left section beam;

attaching one end of a strong flexible tension member to the right bracket;

attaching the other end of the tension member to the left bracket; and tensioning the tension member with a tensioning means such that the tension member supports the lower end of a vertical compression member such that the upper end of the vertical compression member supports the left floor structure and the right floor structure across the mating seam.

14. The method of claim 13 further including:

spanning with a horizontal compression member between the medial side of the left section beam and the medial side of the right section beam substantially between the bracket attachment points.

15. The method of claim 14 further including:

supporting the horizontal compression member with the upper end of the vertical compression member.

16. The method of claim 14 wherein:

in the step of attaching the right bracket to the upper end of the right section beam: the right bracket is attached in front of the horizontal compression member; and in the step of attaching the left bracket to the upper end of the left section beam: the left bracket is attached to the left section beam in back of the horizontal compression member such that the tension member crosses under the horizontal compression member.

17. The method of claim 13 wherein:

in the step of attaching the right bracket to the upper end of the right section beam: the right bracket includes tensioning means for tensioning the tension member.

18. In combination:

a multi-section manufactured home comprising:
- a left section having:
  - a left floor structure; and
  - a beam having:
    - an upper end supporting said left floor structure;
    - a medial side; and
    - a lower end; and
- a right section having:
  - a right floor structure; and
  - a beam having:
    - an upper end supporting said right floor structure;
    - a medial side; and
    - a lower end; said floor structures meeting at a mating seam distal from each said beam; and a brace comprising:
- an elongate strong flexible tension member including:
  - a left end;
  - a right end; and
  - a midsection therebetween;
- right bracket including:
  - an outer end attached to said upper end of said right section beam; and
  - an inner end attached to said right end of said tension member;
- left bracket including:
  - an outer end attached to said upper end of said left section beam; and
  - an inner end attached to said left end of said tension member;
- a vertical compression member including:
  - a lower end supported by said midsection of said tension member; and
  - an upper end supporting said left floor structure and said right floor structure across said mating seam;
- tensioning means for adjusting said tension in said tension member; and
- a horizontal compression member including:
  - a front;
  - a back;
  - a left end;
  - a right end; and
  - a midsection therebetween; said horizontal compression member spanning between said medial side of said left section beam and said medial side of said right section beam substantially between said brackets.

19. The combination of claim 18 wherein:

said upper end of said vertical compression member supports said midsection of said horizontal compression member.

20. The combination of claim 19 wherein:

said outer end of said right bracket is attached to said right section beam in front of said horizontal compression member; and said outer end of said left bracket is attached to said left section beam in back of said horizontal compression member.

21. The combination of claim 19 wherein:

said vertical compression member further includes:
- bearing means on said lower end of said vertical compression member for reducing the friction between said vertical compression member and said tension member during tensioning.

22. The combination of claim 21 wherein:

said upper end of said beam of said left section includes:
- a lateral flange;

said upper end of said beam of said right section includes:
- a lateral flange;

said outer end of said right bracket includes a hook portion hooked over said lateral flange of said upper end of said right section beam; and said outer end of said left bracket includes a hook portion hooked over said lateral flange of said upper end of said left section beam.

23. The combination of claim 22 further including:

a horizontal compression member including:
- a front;
- a back;
- a left end;
- a right end; and
- a midsection therebetween; said horizontal compression member spanning between said medial side of said left section beam and said medial side of said right section beam substantially between said brackets.

24. The combination of claim 23 wherein:

said upper end of said vertical compression member supports said midsection of said horizontal compression member.

25. The combination of claim 18 wherein:

said outer end of said right bracket is attached to said right section beam in front of said horizontal compression member; and said outer end of said left bracket is attached to said left section beam in back of said horizontal compression member.

26. The combination of claim 23 wherein:

said vertical compression member further includes:
- bearing means on said lower end of said vertical compression member for reducing the friction between said vertical compression member and said tension member during tensioning.

* * * * *